US008000447B2

(12) United States Patent
Reijonen et al.

(10) Patent No.: US 8,000,447 B2
(45) Date of Patent: Aug. 16, 2011

(54) CO-AXIAL, HIGH ENERGY GAMMA GENERATOR

(75) Inventors: Jani Petteri Reijonen, Princeton, NJ (US); Frederic Gicquel, Pennington, NJ (US)

(73) Assignee: The Regents of the University of California, Oakland, CA (US)

( * ) Notice: Subject to any disclaimer, the term of this patent is extended or adjusted under 35 U.S.C. 154(b) by 183 days.

(21) Appl. No.: 12/512,424

(22) Filed: Jul. 30, 2009

(65) Prior Publication Data

US 2010/0111258 A1 May 6, 2010

Related U.S. Application Data

(60) Provisional application No. 61/085,722, filed on Aug. 1, 2008.

(51) Int. Cl.

| | |
|---|---|
| ***G21G 4/06*** | (2006.01) |
| ***H05H 1/03*** | (2006.01) |
| ***H05G 1/02*** | (2006.01) |
| ***H01J 35/20*** | (2006.01) |

(52) U.S. Cl. ..... 378/119; 378/193; 250/385.1; 250/438

(58) Field of Classification Search ..... 378/16, 378/91, 98.9, 119, 124, 143, 193, 210; 250/505.1, 250/506.1, 507.1, 522.1, 374, 379, 385.1, 250/493.1, 496.1, 497.1, 498.1, 503.1, 432 R, 250/435–438; 315/111.01, 111.21, 111.31, 315/111.81; 313/231.01, 359.1, 360.1, 362.1, 313/363.1, 545, 552, 567, 568, 577, 581–585, 313/595–600, 604, 609–612, 620–622, 631–634, 313/230

See application file for complete search history.

(56) References Cited

U.S. PATENT DOCUMENTS

| | | | | |
|---|---|---|---|---|
| 2,469,460 | A * | 5/1949 | Fearon | 250/375 |
| 3,421,035 | A * | 1/1969 | Brubaker | 313/360.1 |
| 4,335,465 | A * | 6/1982 | Christiansen et al. | 376/156 |
| 4,675,145 | A * | 6/1987 | Kuswa et al. | 376/108 |
| 5,126,638 | A * | 6/1992 | Dethlefsen | 315/326 |
| 5,502,356 | A * | 3/1996 | McGeoch | 315/111.91 |
| 7,075,096 | B2 * | 7/2006 | McGeoch | 250/504 R |
| 2002/0186815 | A1 * | 12/2002 | McGeoch | 378/119 |

OTHER PUBLICATIONS

King et al., Initial Evaluation of a Pulsed White Spectrum Neutron Generator for Explosive Detection, 2008, Tensor Technology, Inc., pp. 1-5.*

Ludewigt, et al., Coaxial Mono-Energetic Gamma Generator for Active Interrogation, 2008, AIP Conference Proceedings: CAARI2008, pp. 1-4.*

Reijonen, J., Neutron Generators Developed at LBNL for Homeland Security and Imaging Applications, Apr. 22, 2007, Science Direct, Nuclear Instruments and Methods in Physics Research B, vol. 261, pp. 272-276.*

* cited by examiner

*Primary Examiner* — Anastasia Midkiff
(74) *Attorney, Agent, or Firm* — Arent Fox LLP

(57) ABSTRACT

A gamma ray generator includes an ion source in a first chamber. A second chamber is configured co-axially around the first chamber at a lower second pressure. Co-axially arranged plasma apertures separate the two chambers and provide for restricted passage of ions and gas from the first to the second chamber. The second chamber is formed by a puller electrode having at least one long channel aperture to draw ions from the first chamber when the puller electrode is subject to an appropriate applied potential. A plurality of electrodes rings in the third chamber in third pressure co-axially surround the puller electrode and have at least one channel corresponding to the at least one puller electrode aperture and plasma aperture. The electrode rings increase the energy of the ions to a selected energy in stages in passing between successive pairs of the electrodes by application of an accelerating voltage to the successive pairs of accelerator electrodes. A target disposed co-axially around the plurality of electrodes receives the beam of accelerated ions, producing gamma rays.

24 Claims, 4 Drawing Sheets

CO-AXIAL, HIGH ENERGY GAMMA GENERATOR

CROSS REFERENCE TO RELATED APPLICATIONS

This application claims priority to U.S. provisional patent application No. 61/085,722 filed Aug. 1, 2008, entitled "Co-Axial, High Energy Gamma Generator", which is hereby expressly incorporated in its entirety by reference.

STATEMENT OF GOVERNMENTAL SUPPORT

The invention described and claimed herein was made in part utilizing funds supplied by the U.S. Department of Energy under Contract No. DE-AC02-05CH11231. The government has certain rights in this invention.

TECHNICAL FIELD

This disclosure relates to high energy gamma ray (photon) production, and more particularly to production of high energy gamma rays from low energy nuclear reactions.

BACKGROUND

Detecting and characterizing shielded fissionable material (e.g., Special Nuclear Material (SNM)) is a difficult problem. Conventional passive methods rely on spectroscopy of low-energy (less than 500 keV) gamma rays (i.e., photons) from natural decay, but this approach is not suitable when thick shielding may be present. For example, the attenuation of 500 keV gamma rays is such that only about 20% penetrate 2.54 cm of steel shielding, and only about 1% penetrate the same thickness of lead. Higher energy gamma rays can more easily penetrate shielding and, furthermore, increase the detectability of uranium and plutonium isotopes by detecting reaction products of photofission. A means capable of generating a sufficient intensity of high energy photons is needed.

High-energy gamma rays can be produced via (relatively) low energy nuclear reactions. Table 1 summarizes various possible reactions, indicating the minimum incident proton kinetic energy required to initiate the nuclear reaction, the specific reaction concerned, the energy of the emitted gamma ray obtained from the reaction, and the cross-section of the reaction (specified in millibarns). In particular, two reactions for proton induced gamma ray generation are considered (indicated in bold type). One reaction involves $^{11}B(p, \gamma)^{12}C$, i.e., the conversion of boron-11 to carbon-12 by nuclear absorption of a proton, emitting a gamma ($\gamma$) ray. At proton energy of 163 keV, the reaction produces an exit gamma ray of 11.7 MeV, with a cross-section of 0.157 millibarns (mb), which is a measure of the "efficiency" of producing the high energy gamma rays. This reaction is nominally referred to as a "12 MeV" reaction, and protons may conventionally be accelerated to approximately 180 keV or higher to assure a substantial production of 12 MeV gammas rays. A second reaction of interest ($^{19}F(p, \alpha\gamma)^{16}O$) requires a higher proton energy of 340 keV incident on fluorine-19 to emit an alpha particle ($\alpha$) and a 6.1 MeV gamma ray, converting the fluorine-19 to oxygen-16, with a reaction cross section of 160 mb. This reaction is nominally referred to as a "6 MeV" reaction, and protons may conventionally be accelerated to approximately 360 keV or higher to assure a sufficient production of 6 MeV gamma rays.

TABLE 1

| Proton Energy [keV] | Reaction | Gamma Energy [MeV] | Cross Section [mb] |
|---|---|---|---|
| **163** | **$_{11}B(p, \gamma)_{12}C$** | **11.7** | **0.157** |
| 224 | $_{19}F(p, \alpha\gamma)_{16}O$ | 6.1, 6.9, 7.1 | 0.2 |
| 330 | $_{9}Be(p, \gamma)_{10}B$ | 5.2, 6.2, 6.9 | — |
| **340** | **$_{19}F(p, \alpha\gamma)_{16}O$** | **6.1** | **160** |
| 441 | $_{7}Li(p, \gamma)_{8}Be$ | 12.2, 14.7, 17.6 | 6 |

Handbook of Modern Ion Beam Materials Analysis, p. 575 (1995)

FIG. 1 shows a concept for a prior art nuclear reaction gamma ray generator 100, using accelerated protons to impact a target. As shown in FIG. 1, the gamma ray generator 100 shows a plasma generator chamber 105 fed by a gas line 106 at a first pressure suitable for inducing a plasma 110 containing protons or other ionic species. An intermediate second pressure chamber 112 is held at a second pressure by a first vacuum pump 115. A puller electrode 120 with an aperture 125 has an applied voltage biased to draw the positively charged protons (or other positive ions) from the plasma generator chamber 105 into an accelerator chamber 130. The accelerator chamber 130 includes an ion beam accelerator column 140, and a target 150 (containing, for example, boron), where the accelerator chamber 130 is pumped by a second vacuum pump 135 to maintain a third pressure in the accelerator chamber 130 and the accelerator column 140 that is lower than the second pressure, and where the target 150 is maintained at a high negative potential to accelerate the protons to at least 163 keV.

A first vacuum pump 115, coupled to the plasma generation chamber 105 via a gas How limiting plasma aperture 111, maintains a suitable plasma generation pressure at the first pressure in the plasma generator 105 due to gas inflow at the gas line 106 while lowering the pressure at the intermediate second pressure chamber 112. The intermediate second pressure decreases the ion losses due to ion neutralization allowing highly efficient ion transport to the accelerator chamber 130. A second vacuum pump 135 coupled to the accelerator chamber 130 maintains a further lower pressure to provide a satisfactory mean-free-path for the protons to reach the target without substantial loss of energy through collisions along the acceleration path with neutral gas molecules and ensures corona and arcing free operation of the accelerator column 140.

FIG. 2 shows a prior art implementation of a gamma ray generator tube (GT) 200 for the $^{11}B(p, \gamma)^{12}C$ reaction that produces 11.7 MeV gamma rays (hereinafter referred to, for convenience as a "12 MeV GT"). The gamma ray GT 200 of FIG. 2 is an implementation of the key features of the gamma ray generator 100 with associated RF plasma induction electronics, high voltage cabling, feed through and insulation and pressure vessel illustrated. Because the minimum proton energy threshold required to produce this reaction in boron is 163 keV, proton acceleration to a higher energy, e.g., 180 keV is commonly employed to guarantee a sufficient production of gamma rays. There are three key component comprising this implementation of a GT: (1) a source of protons, (2) a proton accelerator to achieve substantially 180 keV, and (3) a target containing boron to supply the nuclear conversion reaction.

Proton production may be obtained by plasma generation in a working gas of hydrogen in an RF-induction cavity, i.e., the plasma generator section 105 of FIG. 1. Referring to FIGS. 1 and 2, Plasma generation may conventionally require a gas pressure on the order of 5 $10\times10^{-3}$ Torr. The accelerator column (e.g., the accelerator column 140 of FIG. 1) requires a low enough pressure to function without discharge arcing, which is commonly lower than the plasma 110 gas pressure. Reducing the pressure for satisfactory operation of the accelerator may be done in stages. In the intermediate second pressure chamber 112, the pump 115 may reduce the pressure, due to the flow limiting plasma aperture 111 to approximately $10^{-4}$ to $10^{-5}$ Torr. The puller electrode 120 has an aperture that is small enough and includes a long channel to limit gas flow into the accelerator column 140. The puller electrode 120 is negatively biased, and therefore functions as an ion extraction aperture to draw positive protons into the accelerator chamber 130. The long channel aperture separates the intermediate pressure second chamber 112 from the accelerator column 140 in the accelerator chamber 130, and a second pumping stage (e.g., the second vacuum pump 135) then lowers the pressure in the accelerator column 140 to about $10^{-6}$ to $10^{-7}$ Torr, or less. In other configurations, the respective pressures in the two chambers may be other than the exemplary pressures suggested here.

Once in the accelerator chamber 130, the required kinetic energy for the desired nuclear reaction must be achieved. In the case of the boron reaction $^{11}B(p, \gamma)^{12}C$ a single pair of electrodes forming an axial beam of protons may be sufficient to obtain the ~180 keV required to produce 12 MeV gamma rays, however the current may not be sufficient to produce gamma rays in sufficient quantity, as determined by the cross-section. In addition, any effort to make the system more compact makes a single pair electrode beam accelerator more difficult to achieve, as the higher electric field gradient under the existing pressure conditions may not be stable, leading to arc discharge. A conventional target material source of boron nuclei is $LaB_6$. For the $^{19}F(p, \alpha\gamma)^{16}O$ reaction, which requires 340 keV, this is correspondingly more difficult. Since fluorine occurs naturally as a gas, a solid fluorinated compound must be used.

It would therefore be advantageous to provide an ion accelerator that reduces the electric field gradient to prevent arc discharge in the accelerator region while providing the kinetic energy needed to produce the desired nuclear reaction.

SUMMARY

A gamma ray generator includes a source of ionized gas in a first chamber maintained at a first pressure, provided by a gas inflow from a gas line at the plasma generator. A second chamber maintained at a lower pressure is configured co-axially to surround the first chamber. A third chamber with a third gas pressure is situated co-axially to surround the second chamber. A puller electrode between the second chamber and the third chamber draws ions from the plasma generator, wherein the puller electrode is configured in a concentric arrangement around the ion source to separate the second chamber from the third chamber and having at least one channel aperture to provide for a restricted passage of ions and gas from the second chamber to the third chamber. A plurality of accelerator electrodes are placed in the third chamber as co-axial rings surrounding the second chamber. The accelerator electrodes have at least one channel corresponding to the at least one puller electrode aperture to provide for the passage of a beam of ions passing from the puller electrode channel through the plurality of accelerator electrodes.

The puller electrode can be used to pulse the ion beam by applying a sufficiently negative pulsed potential to the puller electrode. The puller electrode functions in this manner as a gate electrode between the plasma source and the accelerator column. The puller electrode can be operated at substantially lower potential than the full accelerating voltage of the accelerator column, thus allowing for beam pulsing with a relatively lower potential gating voltage. The accelerator electrodes increase the energy of the ions to a selected energy in successive stages by application of an accelerating voltage to each of the successive pairs of accelerator electrodes. A target disposed co-axially around the plurality of accelerator electrodes receives the at least one beam of accelerated ions of the selected energy. The target material is selected to produce gamma rays resulting from a nuclear reaction with the incident ions.

DETAILED DESCRIPTION OF DISCLOSURE

A method and apparatus for generating high energy monochromatic gamma rays includes a compact low energy proton accelerator and a nuclear target source for generation of high energy gamma rays.

As indicated in Table 1, the cross-section for the boron target reaction is 0.157 mb, a factor of about 1000 less than the cross-section for the fluorine target reaction. To increase the gamma ray production, a design for the proton generator and accelerator is disclosed that provides an increased proton current and corresponding gamma ray production rate. The disclosure provides a structure and method for gamma ray production from either the boron-based or fluorine-based target individually, or simultaneously. The disclosure further provides a structure for generating the proton current and acceleration under differential pressure conditions. The disclosure further provides for a suitable target composition of boron and/or fluorine to enable suitable electrical conditions for the protons to interact effectively with the target. Furthermore, the disclosure provides structures for configuring the boron-based target individually, the fluorine-based target individually, or both target materials together. The disclosure further provides for a differential pumping of two or more chambers concentrically arranged. The disclosure further provides for a pulsed ion beam generation by using a pulsed voltage applied to the puller electrode. The disclosure pertains to other nuclear gamma ray photo-production reactions by suitable modifications and variations of features of the disclosure as may be understood by those skilled in the art.

Referring to Table 1, a trade-off between the two reactions of interest is apparent: a lower proton energy of 163 keV is easier to achieve in a compact system, but the cross-section of the boron reaction ($^{11}B(p, \gamma)^{12}C$) is low compared to the fluorine reaction ($^{19}F(p, \alpha\gamma)^{16}O$), i.e., approximately $1/1000^{th}$ of the latter. To achieve comparable gamma ray flux would require about 1000 times the proton current. On the other hand, accelerating protons to more than 100 keV in a single electrode pair stage may result in arcing if pressure in the accelerator region is not kept low enough. Achieving a higher acceleration energy of 340 keV, as required for the fluorine reaction, is a significant challenge in a compact system.

In one embodiment a multi-beam, coaxial, high ion beam current $^{11}B(p, \gamma)^{12}C$ gamma tube (GT) generating protons in excess of 163 keV for generating 11.7 MeV gamma rays is disclosed. In another embodiment, a lower ion beam current $^{19}F(p, \alpha\gamma)^{16}O$ GT capable of generating protons in excess of 340 keV for generating 6.1 MeV gamma rays is disclosed.

In a third embodiment, a single device encompassing both gamma ray sources (e.g., boron and fluorine), i.e., a "6/12-MeV" GT, is disclosed.

Figure 2:
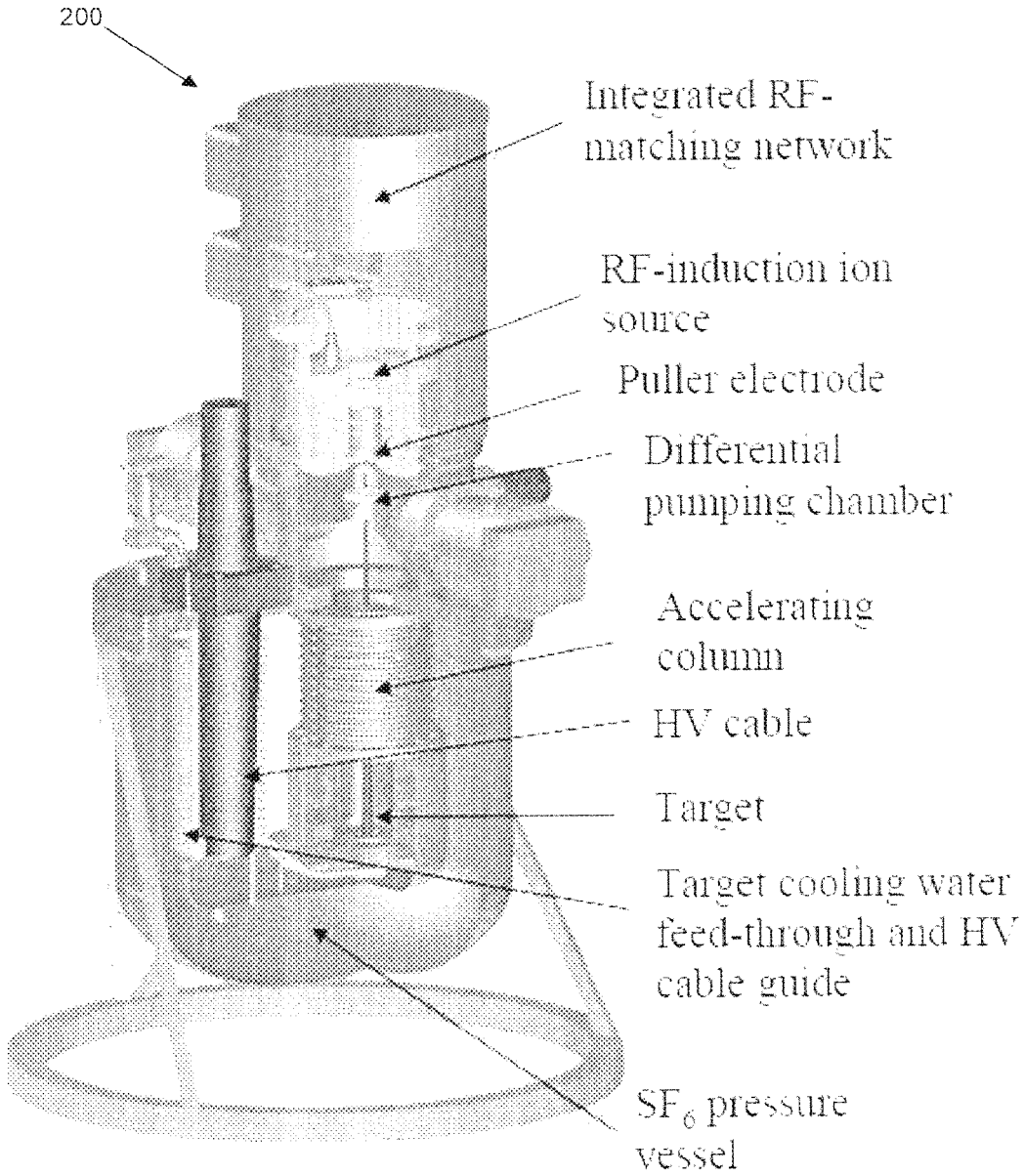
FIGURE 2 (Prior Art)
FIG. 2 shows a perspective view of the prior art implementation of the gamma ray generator tube of FIG. 1.

The prior art implementation of FIG. 2 provides a single beam. This may limit photo-production of gamma rays in the boron reaction if the current generating ability of the accelerator is column is limited, for example, by the aperture of the puller electrode and the low cross-section of 0.157 mb.

Figure 3:
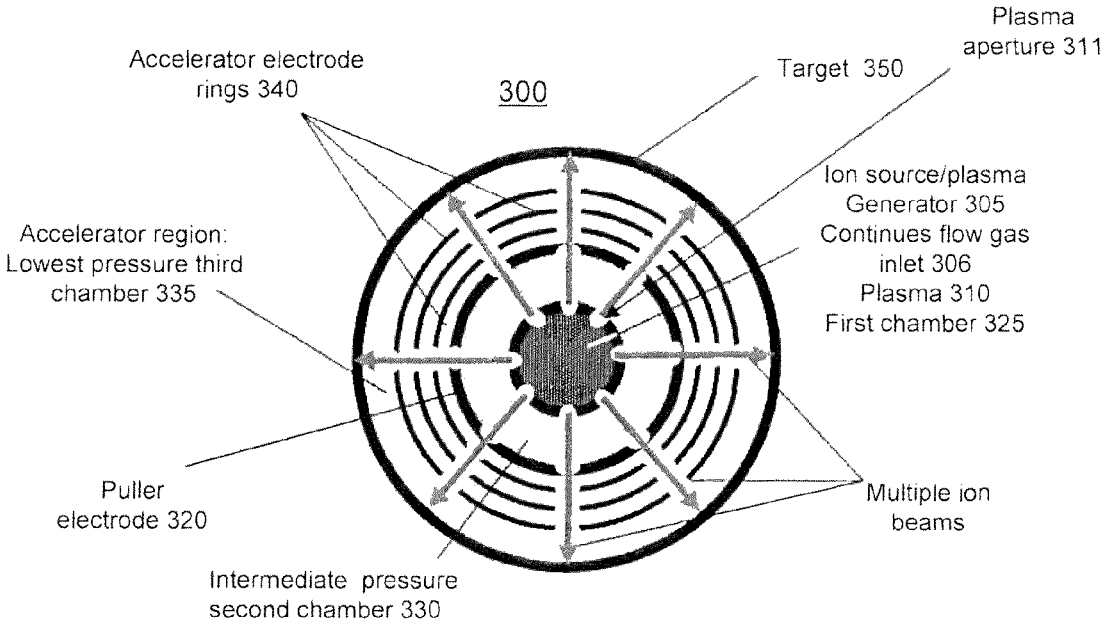
FIG. 3 shows a planar cross-section A-A' of an embodiment of a co-axial gamma ray generator tube of FIG. 4 in accordance with the present disclosure.

FIG. 3 shows a co-axial (i.e., radial) design of a gamma ray generator tube 300 in accordance with the present disclosure that provides multiple beams of ions from a central ion plasma generator 305, with a continuous gas flow inlet 306 and the first chamber 325. Surrounding a first chamber 325 is a second chamber 330, which provides a neutral gas pressure reduced from the pressure in the first chamber 325, and intermediate to a further reduced pressure in a third chamber 335 beyond a puller electrode 320. An accelerator region inside the third chamber 335, instead of being configured in a column to provide linear acceleration of a single beam, is configured as a plurality of slotted aperture accelerator electrode rings 340 in a concentric structure, with a voltage applied to adjacent pairs of accelerator electrode rings 340 successively to accelerate a plurality of beams radially outward toward the target 350 through the slots. A slotted aperture puller electrode 320 surrounds the ion plasma generator region, where the apertures of the puller electrode 320 are aligned with the flow limiting plasma apertures 311 and the slots of the accelerator electrode rings 340. The deliverable ion current may be scaled by changing the number and aperture size of the slots of the plasma aperture 311, the puller electrode 320 and the accelerator electrode rings 340. Differential pumping between the first chamber 325, where the plasma 310 is generated at relatively high pressure from the continuous gas flow 306, and the third chamber 335 containing the accelerator electrode rings 340 and target 350, to maintain lower pressure in the third chamber 335, is an innovative feature of this disclosure. The two chambers are separated by the second chamber 330 formed between the co-axial puller electrode 320 and the wall of the first chamber 325 having one or more plasma apertures 311. The co-axial configuration of accelerator electrode rings 340 may be used to reach 180 keV in steps for use with boron targets and to reach the higher voltage needed for fluorine targets (e.g., approximately 360 keV or more, to exceed the 340 keV threshold).

The vacuum pumping in the intermediate pressure second chamber 330 and the third chamber 335 introduces a gradient in pressure across the plasma aperture 311 and the puller electrode 320, while maintaining high gas pressure in the plasma generator 305 for efficient ion production and very low gas pressure in the accelerator region of the third chamber 335 for reliable high voltage operation. The combination of slot aperture sizes and pumping rates may be optimized to achieve the desired pressures in each region in order to maximize the ion current while providing a satisfactory mean-free-path for the protons to reach the target 350 without substantial loss of energy through collisions along the acceleration paths with neutral gas molecules or by contacting the accelerator electrodes 340. The pressure in the first chamber 325 may be about $5\text{-}10\times10^{-3}$ Torr to support plasma generation. Pressure in the third chamber 335 containing the accelerator electrode rings 340 and target 350 may be about $4\times10^{-6}$ to $10^{-7}$ Torr, or less. Pressure in the intermediate second chamber 330 may be about $5\times10^{-5}$ to $10^{-4}$ Torr.

Figure 4:
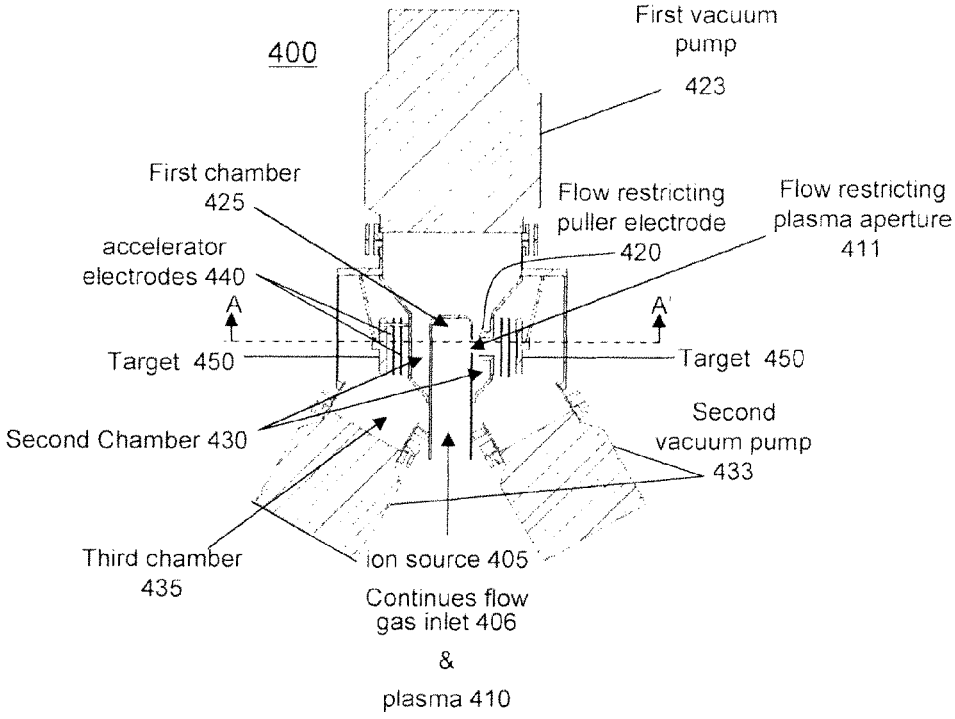
FIG. 4 shows a vertical cross-section of the co-axial gamma ray generator tube of FIG. 3.

FIG. 4 shows a vertical cross-section of one implementation of the co-axial gamma ray generator tube 300 of FIG. 3. FIG. 4 shows an exemplary arrangement of a first vacuum pump 423 directly coupled to a second chamber 430 to maintain a first pressure in a first chamber 425 via a flow limiting plasma aperture 411 between the first chamber 425 and the second chamber 430, generating simultaneously a lower second pressure in the second chamber 430. One or more second vacuum pumps 433 maintain a third pressure in a third chamber 435. A target 450 and accelerator electrodes 440 are located concentrically in the third chamber 435, whereas a gap between a puller electrode 420 and the plasma aperture 411 comprises the second chamber 430 of second pressure intermediate between the first and third pressure. In the embodiment of FIG. 4, a plurality of second vacuum pumps 433 may be advantageous to achieve the lower pressure level in the third chamber 435. A central ion source 405 provides the ion plasma 410 with a continuous inflow of neutral gas from a gas inlet 406 maintained at the first pressure.

Figure 5:
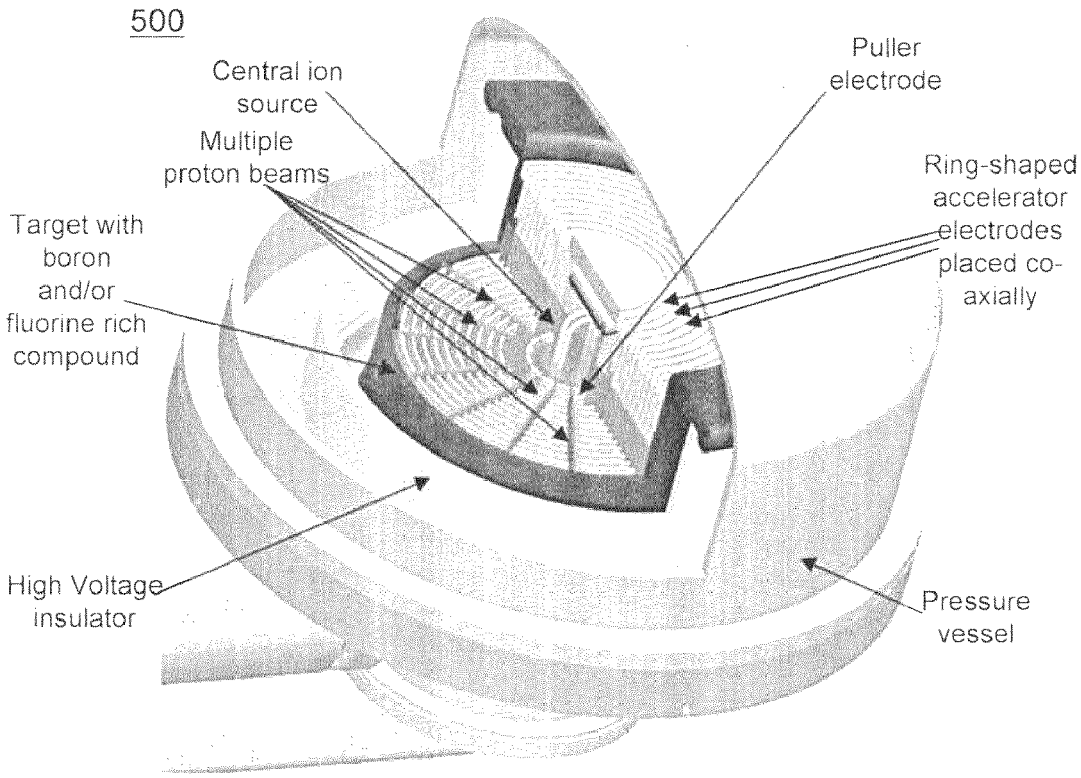
FIG. 5 shows a perspective view of another embodiment of the gamma ray generator tube of FIG. 3.

FIG. 5 shows a perspective view of another embodiment of a gamma ray generator tube 500 in accordance with the present disclosure, including a central ion source plasma generator surrounded concentrically by a puller electrode, which in turn is surrounded by co-axially (i.e., concentrically) placed accelerator electrodes, which are further surrounded co-axially by a target. The target may be a boron compound, a fluorine compound, or a combination of both, as described in further detail below. The target is supported by a co-axially positioned high voltage insulator, and the various structures are contained in a $SF_6$ pressure vessel. Pressurized $SF_6$ is a gaseous insulator used in high voltage applications to suppress arcing.

Figure 1:
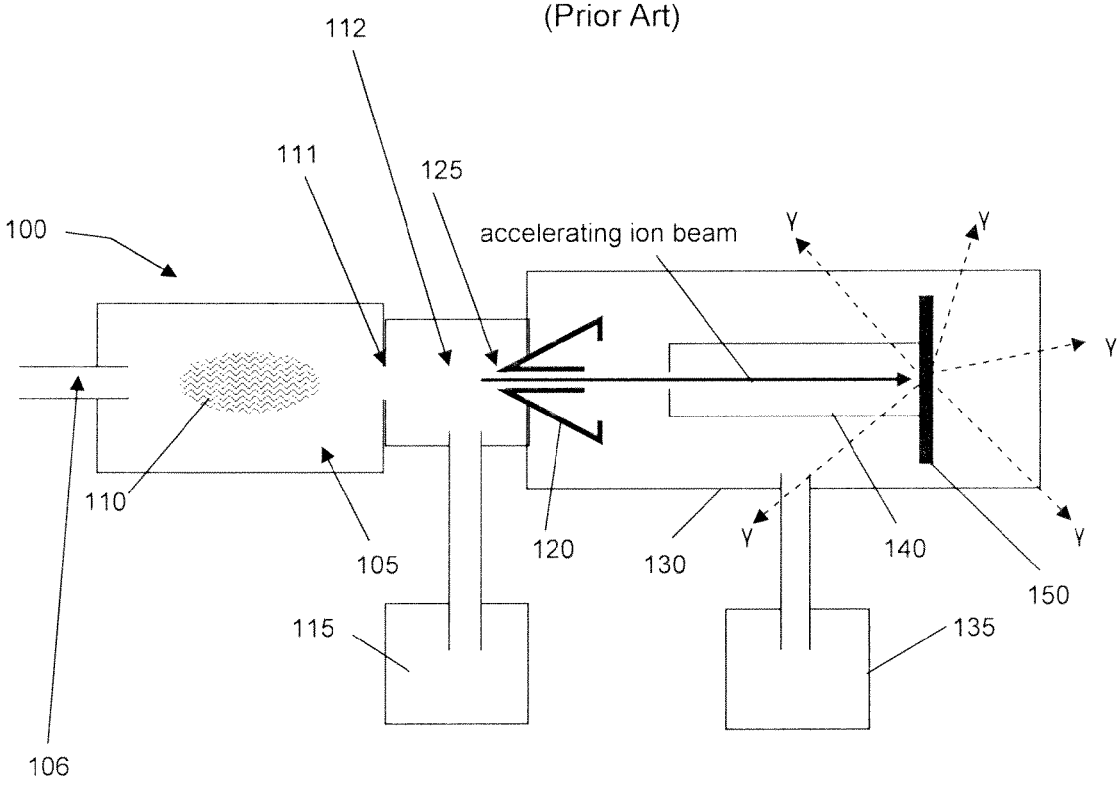
FIGURE 1 (Prior Art)
FIG. 1 shows a prior art concept for a nuclear reaction gamma ray generator tube.

Another aspect of the disclosure is the nature of the target. Conventional GTs, as described above with reference to FIGS. 1 an 2, commonly use $LaB_6$ as the boron target material. The problem in using $LaB_6$ target is related to it's property of being a low work function electron emitter when heated to elevated temperature. For the gamma generator this means that the target will work as a electron emitter, which would greatly load the accelerator column and the high voltage power supply by emitting electrons back towards to the ion source and the accelerator column. In order to avoid the harmful secondary electron emission in the accelerator column, a secondary electron filter electrode may conventionally be designed in the GT to provide appropriate biasing of the target in comparison to the filter electrode. This results in an undesirably more complicated high voltage circuitry.

An embodiment in accordance with this disclosure is to use pure boron as a target material for the gamma generation. There are two advantages of pure boron over $LaB_6$: first, the pure boron is substantially 100% $^{11}B$, which enhances the gamma yield, secondly the boron crystal is weakly conducting. In normal circumstances the weakly conducting target material would be a problem, but in the case of a gamma generator, this property leads to self biasing of the target. Depending on the temperature of the boron target, the positive potential on the target surface can be from a few tens of volts to hundreds of volts. This self-biasing nature of the target surface renders secondary electron filtering unnecessary, thus simplifying the electrode structure of the gamma generator. Self biasing occurs when a positive ion beam strikes the target surface, and charges up the surface more positively in comparison to the surrounding electrodes. This positive target surface will attract the secondary electrons back to the target, thus suppressing the electron emission. An insulating material would be unsuitable, due to a too large voltage drop across the target surface. However, the weakly conducting boron (at elevated temperature) is very suitable for self-biasing and secondary electron filtering from the target.

A similar challenge arises in the case of fluorine. However, a target material with similar electrical properties could be fluorite ($CaF_2$). This material is also weakly conducting, with a dielectric constant of ~6. It would also self-bias in a manner similar to pure boron, and the melting temperature is high at ~1300 C, so that it can withstand heating from the proton beam.

Another aspect of the disclosure is the ability to combine both target materials in one target ring to obtain both 6 MeV and 12 MeV photoproduction. One embodiment of the combination target may be an inner layer/outer layer, where one target material is disposed as a "jacket" around the other. In one embodiment, it may occur that a portion of 360 keV protons transiting first a fluorine-based target scatters and loses energy without being absorbed, making these scattered protons better suited to interact with boron. In this embodiment, it may be preferable to have the boron-based target as the outer target and the fluorine-based target as the inner target. The thickness of each layer may be selected to provide the desired ratio of 6 MeV/12 MeV gamma rays, taking into consideration the cross-section of each reaction, and the currents generated in the accelerator rings. In other embodiments, the reverse order of target materials may be preferred.

In another embodiment, the puller electrodes and accelerator rings may be adapted (e.g., segmented) to provide proton beams selected to have different energies, in which case the target may be segmented around the circumference to provide target material appropriate to the energy of the beam. That is, a subset of ~180 keV beams may be directed at boron-based portions of the target and the complement or another subset of ~360 keV beams may be directed at fluorine-based portions of the target.

In another embodiment the puller electrode can be used to pulse the ion beam by applying a sufficient pulsed negative potential to the puller electrode, thus controlling the extraction of the positive ions from the plasma generator. The puller electrode functions in this manner as a gate electrode between the plasma source and the accelerator column. The puller electrode can be operated at substantially lower potential than the lull energy at the accelerator column, thus allowing for high energy beam pulsing with a lower puller electrode potential.

In another embodiment, the proton beams, or a subset of the beams, may be shaped substantially as "ribbons" by design of the aperture channels, and the targets may be formed as a layered set of rings stacked in the direction defined by the common axis of the accelerator rings, e.g., like a layer cake with the accelerator rings in the center, so that a ribbon beams may intersect and irradiate layers of each type of target.

In another embodiment, the target may have a single composite composition of boron and fluorine compounds, a gradient composite of compounds, or a composite of tiles of the two compounds, in various spatial arrangements, where the mass fractions of boron and fluorine are selected to substantially obtain a desired ratio of 6 MeV/12 MeV gamma rays.

In another embodiment, referring to Table 1, the target may comprise Li-7, and be irradiated by proton beams accelerated to energies of at least 441 keV to produce gamma rays with energies of 12.1, 14.7, and 17.6 MeV. The structure of the generator tube may be substantially the same, with the number and spacing of concentric accelerator electrodes 340 needed to reach at least 441 keV being determined by the voltage steps between the successive pairs of accelerator electrodes 340. Additionally, the target may comprise any combinational mixture of target materials selected from among materials including boron-11, fluorine-19 and Li-7 in the various ways described above to obtain a desired intensity ratio of the various gamma ray energies available from the proton-nucleon reactions.

It may be appreciated that other target materials may be adapted and used in a modification of the gamma ray generator described above for generation of other energies of gamma rays for different spectroscopic analysis, for example, of other materials. Furthermore, the various target materials may be arranged in various spatial arrangements similar to configurations described above to achieve the same objective of high gamma ray photoproduction.

Although the present disclosure and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate, processes, machines, manufacture, compositions of matter, means, methods, or steps, presently existing or later to be developed that perform substantially the same function or achieve substantially the same result as the corresponding embodiments described herein may be utilized according to the present disclosure.

What is claimed is:

1. A gamma ray generator comprising:

a first chamber maintained at a first pressure, the first chamber including a concentric wall to form an outer surface of the first chamber;

an ion source in the first chamber to form an ionized gas from a continuous inflow of a neutral gas;

at least one flow limiting plasma aperture in the concentric wall to provide for a restricted passage of ions and gas from the first chamber;

a second chamber maintained at a second pressure in a concentric ring around the first chamber, the second chamber receiving through the at least one flow limiting plasma aperture the restricted passage of ions and gas from the first chamber;

a first vacuum pump coupled to the second chamber, the second chamber coupled to the first chamber via the at least one flow limiting plasma aperture, to maintain the first pressure and the second pressure;

a third chamber maintained at a third pressure, the third chamber configured co-axially to surround the second chamber;

a puller electrode arranged concentrically between the second chamber and the third chamber, wherein the puller electrode has an applied voltage to electrostatically draw ions from the ionized gas in the second chamber that have passed from the first chamber through the at least one flow limiting plasma aperture;

at least one flow restricting aperture in the puller electrode located radially in correspondence to the at least one flow limiting plasma aperture to provide for a restricted passage of ions electrostatically drawn from the second chamber to the third chamber;

a second vacuum pump coupled to the third chamber to maintain the third pressure lower than the second and the first pressure in the second and the first chamber respectively;

a plurality of accelerator electrodes in the third chamber placed as concentric rings co-axially surrounding the puller electrode and the second chamber, the accelerator electrodes having at least one radial channel aperture located in radial correspondence to the at least one flow restricting aperture in the puller electrode and one flow limiting plasma aperture to provide for the passage of a beam of ions from the plasma generator through the puller electrode and the plurality of accelerator electrodes, and wherein the accelerator electrodes increase a value of the energy of the ions to a selected energy in successive stages in passing between successive pairs of the accelerator electrodes by application of an accelerating voltage to each of the successive pairs of accelerator electrodes; and a target material disposed co-axially around the plurality of accelerator electrodes to receive the at least one beam of ions of the selected energy to provide gamma ray emission by a nuclear reaction between the target material and the ions.

2. The gamma ray generator of claim 1, in which the first chamber pressure is approximately 5-10 $10^{-3}$ Torr.

3. The gamma ray generator of claim 1, in which the third chamber pressure is approximately $4\times10^{-6}$ to $10^{-7}$ Torr or less.

4. The gamma ray generator of claim 1, in which the second chamber pressure is approximately $5\times10^{-5}$ to $10^{-4}$ Torr.

5. The gamma ray generator of claim 1, in which a value of pressure differential between the first chamber and the third chamber is a ratio between approximately $10^{-3}$ to $10^{-5}$.

6. The gamma ray generator of claim 1, in which the target comprises boron-11.

7. The gamma ray generator of claim 6, in which the target consists substantially of elemental boron-11.

8. The gamma ray generator of claim 6, in which the ions are protons generated from ionized hydrogen.

9. The gamma ray generator of claim 6, in which the ions are accelerated to a kinetic energy of at least 163 keV.

10. The gamma ray generator of claim 1, in which the target comprises fluorine-19.

11. The gamma ray generator of claim 1, in which the target material consists substantially of $CaF_2$, where F is fluorine-19.

12. The gamma ray generator of claim 10, in which the ions are protons generated from ionized hydrogen.

13. The gamma ray generator of claim 12, in which the ions are accelerated to a kinetic energy of at least 340 keV.

14. The gamma ray generator of claim 1, in which the target comprises fluorine-19 and boron-11.

15. The gamma ray generator of claim 14, in which the ions are protons generated from ionized hydrogen.

16. The gamma ray generator of claim 15, in which the ions are accelerated to a kinetic energy of at least 340 keV.

17. The gamma ray generator of claim 1, in which the target comprises Li-7.

18. The gamma ray generator of claim 17, in which the ions are protons generated from ionized hydrogen.

19. The gamma ray generator of claim 18, in which the ions are accelerated to a kinetic energy of at least 441 keV.

20. The gamma ray generator of claim 1, in which the target comprises Li-7 and at least one of fluorine-19 and boron-11.

21. The gamma ray generator of claim 20, in which the ions are protons generated from ionized hydrogen.

22. The gamma ray generator of claim 21, in which the ions are accelerated to a kinetic energy of at least 441 keV.

23. The gamma ray generator of claim 1, in which a time-gated voltage pulse applied to the puller electrode provides a time gated ion beam pulse to be accelerated toward the target material by the accelerator electrodes in the third chamber.

24. A method of generating gamma rays comprising:

providing a first chamber maintained at a first pressure, the first chamber including a concentric wall to form an outer surface of the first chamber;

providing an ion source in the first chamber to form an ionized gas from a continuous inflow of a neutral gas;

providing at least one flow limiting plasma aperture in the concentric wall to provide for a restricted passage of ions and gas from the first chamber;

providing a second chamber maintained at a second pressure in a concentric ring around the first chamber, the second chamber receiving through the at least one flow limiting plasma aperture the restricted passage of ions and gas from the first chamber;

pumping the second chamber with a first vacuum pump to maintain the second pressure, and maintain the first pressure in the first chamber via the flow limiting plasma aperture;

providing a third chamber maintained at a third pressure, the third chamber configured co-axially to surround the first and the second chamber;

locating between the second chamber and the third chamber a concentrically arranged puller electrode, wherein the puller electrode has an applied voltage to draw ions from the ionized gas in the first chamber passing through the at least one flow limiting plasma aperture;

providing in the puller electrode at least one flow restricting aperture located radially in correspondence to the at least one flow limiting plasma aperture to provide for a restricted passage of ions and gas from the second chamber to the third chamber;

drawing ions from the ionized gas by applying an appropriate voltage potential to the puller electrode to electrostatically control the passage of ions from the second chamber to the third chamber;

pumping the third chamber with a second vacuum pump to maintain the third pressure lower than the first and the second pressure in the first and the second chamber respectively;

accelerating the ions in at least one beam in the third chamber to increase a value of the energy of the ions to a selected energy in successive stages by passing the ions through a plurality of accelerator electrodes placed as concentric rings co-axially surrounding the puller electrode, the accelerator electrodes having at least one channel located in radial correspondence with the at least one puller electrode flow restricting aperture and at least one flow limiting plasma aperture to provide for the passage of a beam of ions from the puller electrode flow restricting aperture through the plurality of accelerator electrodes, wherein an accelerating voltage is applied to each of the successive pairs of accelerator electrodes; and receiving the at least one beam of ions of the selected energy at a target material disposed co-axially around the plurality of accelerator electrodes to provide gamma ray emission by a nuclear reaction between the target material and the ions.

* * * * *